US005806253A

United States Patent [19]

Nelson

[11] Patent Number: 5,806,253

[45] Date of Patent: Sep. 15, 1998

[54] STAIR NOSING FOR LAMINATE FLOORING

[75] Inventor: Thomas J. Nelson, Belton, Tex.

[73] Assignee: Premark Rwp Holdings, Inc., Temple, Tex.

[21] Appl. No.: 740,600

[22] Filed: Oct. 31, 1996

[51] Int. Cl.[6] ..... F04F 11/16

[52] U.S. Cl. ..... 52/179; 52/288.1; 52/718.04

[58] Field of Search ..... 52/179, 287.1, 52/288.1, 716.4, 718.01, 718.04; 108/27; 312/137, 140.1, 140.3, 140.4; 248/345.1

[56] References Cited

U.S. PATENT DOCUMENTS

| | | | |
|---|---|---|---|
| 2,981,580 | 4/1961 | Hansen | 108/27 |
| 3,318,061 | 5/1967 | Stentz | 52/288.1 |
| 4,112,641 | 9/1978 | Balzer . | |
| 4,430,833 | 2/1984 | Blazer et al. | 52/288.1 |
| 4,455,797 | 6/1984 | Naka . | |
| 4,486,987 | 12/1984 | Naka . | |
| 5,103,608 | 4/1992 | Andreo . | |

FOREIGN PATENT DOCUMENTS

| | | | |
|---|---|---|---|
| 249307 | 1/1966 | Austria | 108/27 |
| 48490 | 4/1940 | Netherlands | 52/179 |

*Primary Examiner*—Michael Safavi
*Attorney, Agent, or Firm*—Michael J. D'Amelio

[57] ABSTRACT

A stair nosing for the installation of laminate flooring on stair steps. The stair molding has an elongated, rigid base member for installation of the stair nosing on the leading edge of a stair step and an elongated, flexible tread member covering and interlocked with the rigid base member. The base member has a nose portion with a rounded front surface for defining a leading edge on a stair step and planar back surfaces that intersect at right angles. Flanges extend laterally from and on the same plane as the back surfaces of the nose portion for positioning the base portion on the tread and riser of a stair step.

34 Claims, 5 Drawing Sheets

STAIR NOSING FOR LAMINATE FLOORING

BACKGROUND OF THE INVENTION

1. Field of the Invention

This invention relates to stair nosing for laminate flooring.

2. Description of the Related Art

Commercially available laminate flooring generally includes a wear surface glued to a substrate. The wear surface generally is high-wear resistant decorative laminate. The substrate generally is fiber board or particle board. Each piece of laminate flooring generally has a groove along one end and one side suitable for joining with a tongue along one side or end of an adjacent piece of laminate flooring.

Stair nosing with base and tread members is disclosed for installation on concrete steps (U.S. Pat. No. 4,112,641) and for installing carpet on stairs (U.S. Pat. No. (4,455,797). There is no disclosure of stair nosing with a rigid base member and flexible tread member.

SUMMARY OF THE INVENTION

The stair nosing of this invention was developed for the installation of laminate flooring on stair steps. This stair molding has an elongated, rigid base member for installation of the stair nosing on the leading edge of a stair step and an elongated, flexible tread member covering and interlocked with the rigid base member. The base member has a nose portion with a rounded front surface for defining a leading edge on a stair step and planar back surfaces that intersect at right angles. Flanges extend laterally from and on the same plane as the back surfaces of the nose portion for positioning the base portion on the tread and riser of a stair step.

The nose portion has shoulders extending between the front surface of the nose portion and the front surfaces of the flanges for abutment with laminate flooring installed on a tread and riser. The nose portion has a groove extending along its front surface. The flexible tread member has a rib extending from its back surface for engaging the side walls of the groove and interconnecting the base and tread members. The flexible tread member has flaps covering the nose portion and extending beyond the shoulders.

The back surfaces of the base member can be serrated for affixing the stair nosing on the stair step. The flanges can have a nailing groove on their front surfaces for affixing the stair nosing on the stair step. The back surfaces of the base member intersect at right angles for positioning the base member on a tread and riser, at the leading edge of a stair step. The flanges are about the same height as a pad that holds laminate flooring above the tread on a stair step and have about the same height as the laminate flooring that is to abut the shoulder. The height of the shoulder can be greater than the height of laminate flooring that is to abut the shoulder.

The flaps of tread member can have pads for holding laminate flooring below the front surface of nose portion. The flaps can terminate with sloping shoulders for providing a smooth transition between laminate flooring and the front surface of the stair nosing. The shoulder that will abut laminate flooring on the tread of a stair step can be a planar surface extending at right angles from the front surfaces of the nose portion and the flange for positioning the base member onto the tread of a stair step. A groove can extend along this shoulder for interlocking with a tongue on laminate flooring.

The shoulder that will abut laminate flooring on the riser of a stair step can be a planar surface extending from the front surfaces of the nose portion and the flange for positioning the base member onto the riser of a stair step. The shoulder that will abut laminate flooring on the riser of a stair step can be a planar surface extending at an obtuse angle from the front surfaces of the nose portion and the flange for positioning the base member onto the riser of a stair step.

The width of the groove on the front surface of the nose portion and rib can be the same. Serrations can extend along the groove on the front surface of the nose portion for interlocking with serrations extending along the rib for securely interconnecting the flexible tread and rigid base member. The rib and serrations extending along the rib can be sized and the serrations can be spaced for interlocking with serrations extending along the side walls of the groove. Serrations along the rib can extend beyond the rib. A serration along the rib can be spaced for engaging the side wall of the groove below the lowest serration extending along the groove. Flexible flaps can extend from the end of the rib for resisting the removal of rib from groove. The flexible flaps extending from the end of the rib can engage the walls of the groove below the lowest serration.

The base member can be made by extrusion molding metal, preferably aluminum, or rigid synthetic resin. The tread member can be made by extrusion molding flexible synthetic resin, such as vinyl resin.

DETAILED DESCRIPTION OF THE INVENTION

Figure 2:
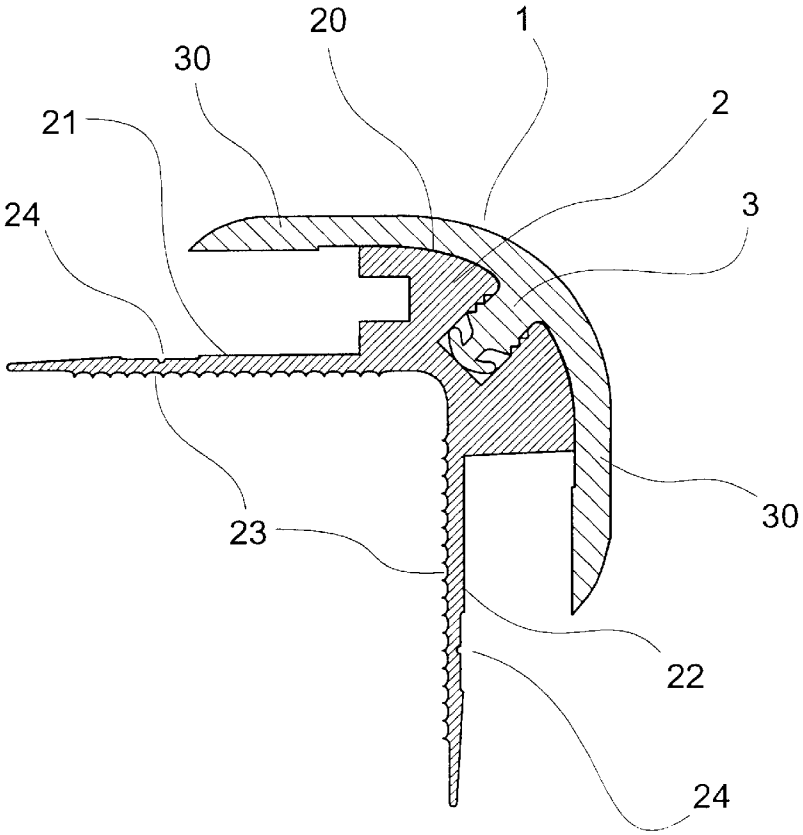
FIG. 2 is a cross section view of the stair nosing of this invention.
Figure 1:
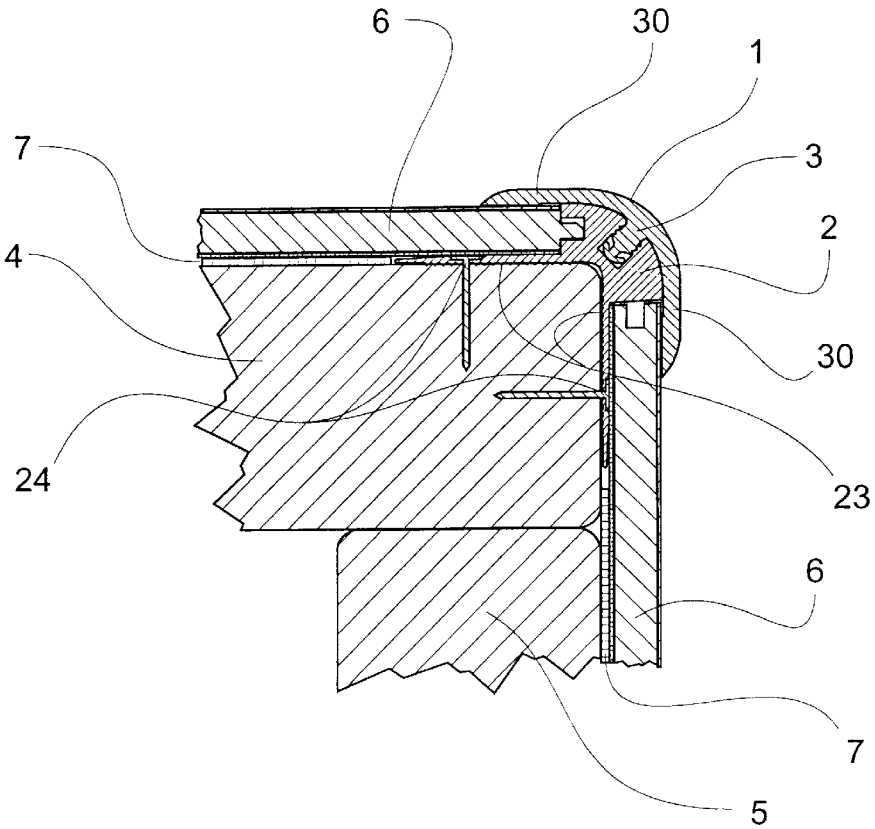
FIG. 1 is a cross section view of a stair nosing of the present invention installed with laminate flooring on the leading edge of a stair step.

The stair nosing (1) of this invention comprises an elongated, rigid base member (2) recovered by and interlocked with an elongated, flexible tread member (3), FIGS. 1 and 2. The base member (2) has a nose portion (20) with flanges (21 and 22) extending laterally from and on the same plane as the back surface of the nose portion for positioning the stair nosing on the leading edge of a stair step. The back surfaces are serrated (23) for affixing the stair nosing on the stair step. The flanges also have a nailing groove (24) on their front surfaces to accommodate proper positioning of nails that affix the stair nosing to the stair step.

Stair nosing (1) of this invention installed with laminate flooring (6) on the leading edge of a stair step is shown on FIG. 1. Laminate flooring (6) is installed over a pad (7). The stair nosing is affixed on the leading edge of a stair step with serrations (23) and nails driven through nailing grooves (24). The flexible tread member (3) has flaps (30) extending over laminate flooring (6) on the tread (4) and riser (5) of a stair step. The flaps (30) cover the edge of the laminate flooring at the stair nosing and hold the laminate flooring in place on the tread and riser.

The back surfaces of the base member (2) intersect at right angles for positioning the base member on a tread, at the leading edge of a stair step. The nose portion (20) of the base member (2) has a front, generally rounded surface for defining the nose of the stair step FIGS. 3 and 6. The back side of the nose portion has planar surfaces that intersect at right angles. The front surface of the nose portion (20) terminates with shoulders (25 and 29) for abutment with edges of laminate flooring on the tread and riser of a stair step.

The flanges (21 and 22) are about the same height that a pad holds laminate flooring above the tread on a stair step. The shoulders (25 and 26) have about the same height as the laminate flooring that is to abut the shoulder. In the embodiment shown in FIGS. 1–7, the height of the shoulder is greater than the height of laminate flooring that is to abut the shoulder. The flaps (30) of tread member (3) have pads (35) for holding laminate flooring below the front surface of nose portion (20), FIGS. 4 and 7. Laminate flooring can have sharp edges that could cut the flaps (30). By holding the laminate flooring below the front surface of the nose portion (20) the tread member does not touch the flaps (30). Additionally, flaps (30) terminate with sloping shoulders (36) for providing a smooth transition between laminate flooring and the front surface of the stair nosing.

Figure 3:
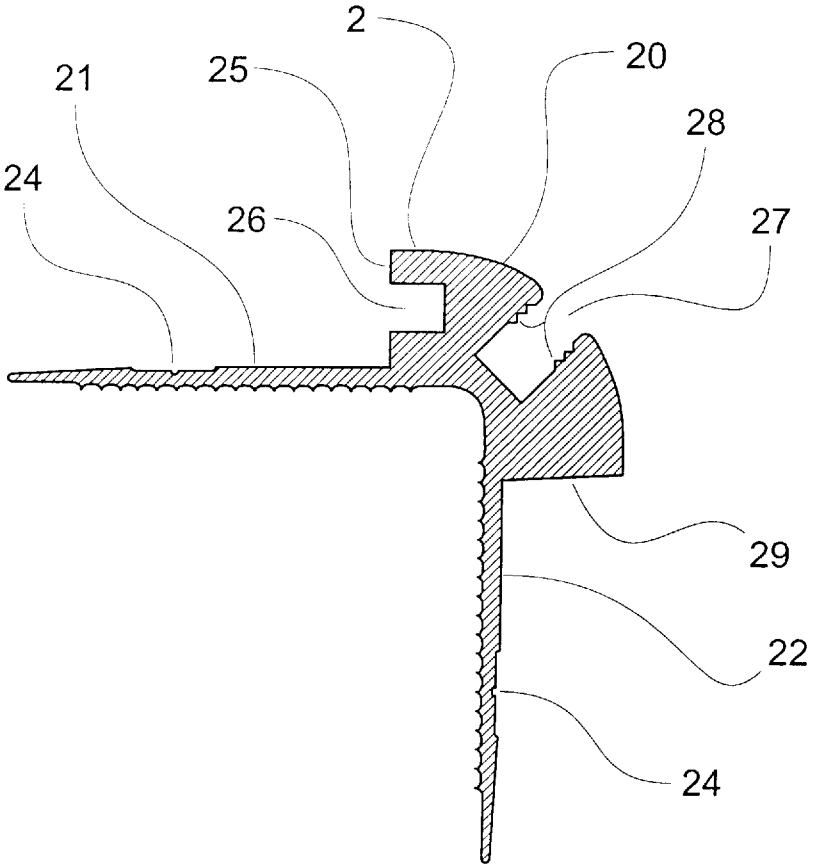
FIG. 3 is a cross section view of a base member of the stair nosing of this invention.
Figure 5:
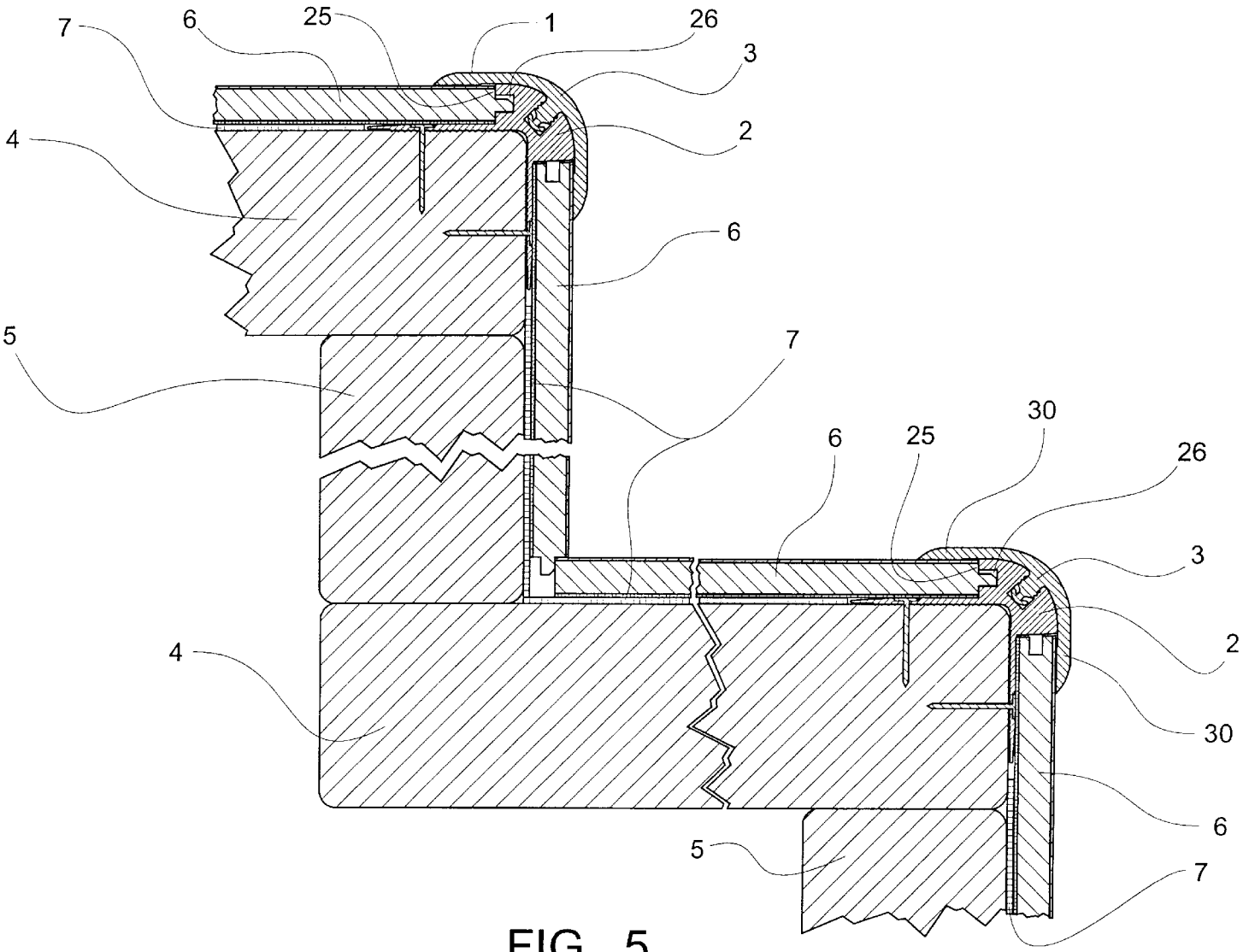
FIG. 5 is a cross section view of laminate flooring installed on stair steps with the stair nosing of this invention.
Figure 6:
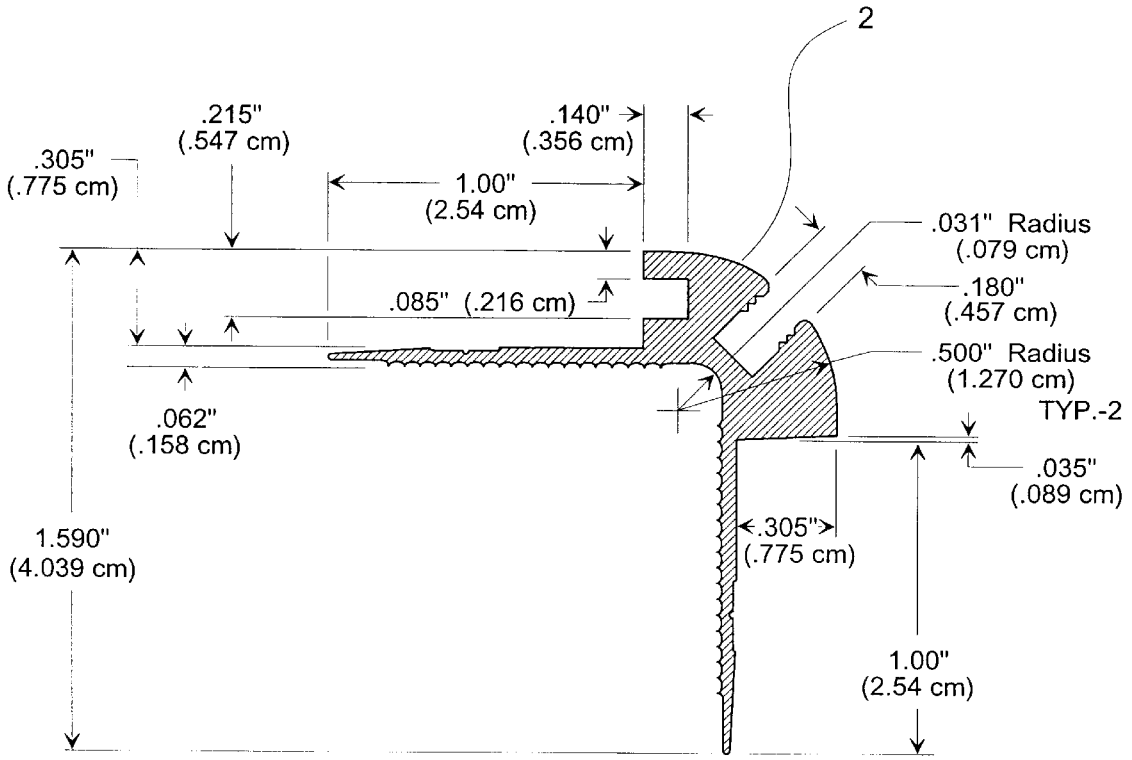
FIG. 6–7 show the Metric and English dimensions of features of a specific embodiment of a base member and tread member of the stair nosing of this invention.
Figure 7:
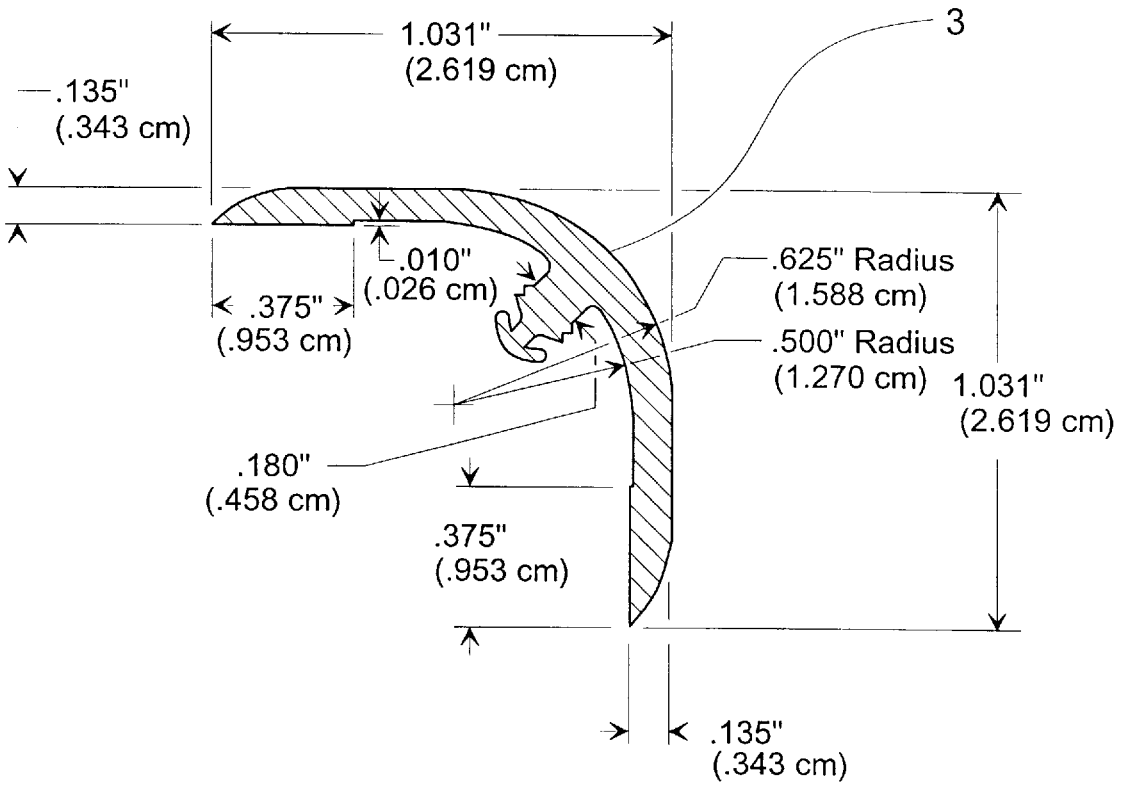

The shoulder (25) that will abut laminate flooring on the tread of a stair step, as shown in the embodiments on FIGS. 1 and 5, is a planar surface extending at right angles from the front surfaces of the nose portion (20) and the flange (21) for positioning the base member (2) onto the tread (4) of a stair step, FIGS. 3 and 6. A groove (26) extends along this shoulder (25) for interlocking with a tongue on laminate flooring. Interlocking of a tongue of laminate flooring with the groove along the shoulder (25) can hold laminate flooring on a tread of a stair step below the front surface of the nose portion (20), FIGS. 1 and 5.

The shoulder (29) that will abut laminate flooring on the riser (5) of a stair step, as shown in the embodiments on FIGS. 1 and 5, is a planar surface extending at an obtuse angle from the front surfaces of the nose portion (20) and the flange (22) for positioning the base member (2) onto the riser (5) of a stair step, FIGS. 3 and 6. The laminate flooring shown on FIGS. 1 and 5 has its grooved edge in abutment with this shoulder (29) on the riser of a stair step. This grooved edge of laminate flooring is shown as being cut at an acute angle to the front surface of the flooring. A groove (27) with side walls extends along the front surface of the nose portion (20) for receiving a flexible rib (31) extending along and from the back surface of the tread member (3), FIGS. 2, 3, 4, 6 and 7. The rib (31) engages the side walls of the groove (27) with sufficient friction for securely interconnecting the tread member (3) and base member (2).

Figure 4:
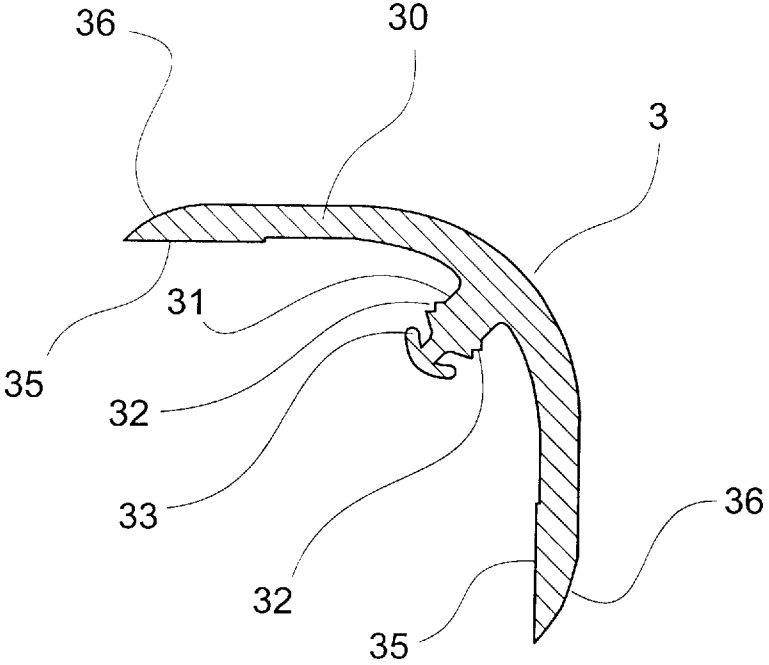
FIG. 4 is a cross section view of a tread member of the stair nosing of this invention.

Serrations (28) extend along the groove (27) for interlocking with serrations (32) extending along the rib (31) for securely interconnecting the flexible tread and rigid base member, FIGS. 2, 3 and 4. Flexible flaps (33) extend from the end of the rib for resisting the removal of rib (31) from groove (27). The tread member may be removed from the base member by prying the tread member upwardly.

The rib (31) and serrations (32) extending along the rib are sized and the serrations are spaced for interlocking with serrations (28) extending along the side walls of the groove, FIGS. 2, 3, 4, 6 and 7. The width of the groove and rib are the same, FIGS. 6 and 7. Serrations along the rib extend beyond the rib. A serration along the rib is spaced for engaging the side wall of the groove below the lowest serration extending along the groove, FIG. 2. Flexible flaps extending from the end of the rib engage the walls of the groove below the lowest serration, FIG. 2. The flexible flaps and the serrations extending along the rib resist the removal of the rib from the groove.

The base member (2) is made by extrusion molding metal, preferably aluminum, or rigid synthetic resin. The tread member (3) is made by extrusion molding flexible synthetic resin, such as vinyl resin. The selection of suitable materials, methods and equipment for extrusion molding the base and tread members are known to those skilled in the are of making extruded molding.

The installation of laminate flooring on stair steps is shown on FIGS. 1 and 5. Laminate flooring (6) on the tread (4) is installed over a pad (7). The tongue on the laminate flooring and the groove (26) along the shoulder (25) on the base member (2) are interlocked for holding the laminate flooring in place on the tread. The flap (30) on the tread member (3) also holds the flooring in place on the tread. Laminate flooring (6) on the riser (5) is installed over a pad (7), FIG. 5. The tongue on the laminate flooring on the riser extends below the front surface of the laminate flooring on the tread (4) for holding the laminate flooring against the riser. The flap (30) on the tread member (3) also holds the flooring in place on the riser.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty that reside in the present invention, including all features that would be treated as equivalents thereof by those skilled the art to which this invention pertains.

I claim:

1. A stair nosing for the installation of laminate flooring on stair steps, comprising;

an elongated, rigid base member for installation of the stair nosing on the leading edge of a stair step and an elongated, flexible tread member covering and interlocked with the rigid base member, the base member having a nose portion with a rounded front surface for defining a leading edge on a stair step and planar back surfaces that intersect at right angles and flanges extending laterally from and on the same plane as the back surfaces of the nose portion for positioning the base portion on the tread and riser of a stair step, the nose portion having a shoulder extending between the front surface of the nose portion and a front surface of the flanges for abutment with laminate flooring installed on a tread and a shoulder extending between the front surface of the nose portion and a front surface of the flanges for abutment with laminate flooring installed on a riser, the nose portion having a groove extending along its front surface, the flexible tread member having a rib extending from its back surface for engaging the side walls of the groove and interconnecting the base and tread members, and the flexible tread member having flaps covering the nose portion and extending beyond the shoulders.

2. Stair nosing of claim 1, wherein the back surfaces of the base member are serrated for affixing the stair nosing on the stair step.

3. Stair nosing of claim 1, wherein the flanges have a nailing groove on their front surfaces to accommodate proper positioning of nails that affix the stair nosing to the stair step when the stair nosing is installed.

4. Stair nosing of claim 1, wherein the back surfaces of the base member intersect at right angles for positioning the base member on a tread, at the leading edge of a stair step.

5. Stair nosing of claim 1, wherein the flanges are about the same height as a pad that holds laminate flooring above the tread on a stair step when the stair nosing is installed.

6. Stair nosing of claim 1, wherein the shoulders have about the same height as the laminate flooring that is to abut the shoulder when the stair nosing is installed.

7. Stair nosing of claim 1, wherein the height of the shoulder is greater than the height of laminate flooring that is to abut the shoulder when the stair nosing is installed.

8. Stair nosing of claim 1, wherein the flaps of the flexible tread member have pads for holding laminate flooring below the front surface of the nose portion.

9. Stair nosing of claim 1, wherein the flaps terminate with sloping shoulders for providing a smooth transition between laminate flooring and the front surface of the stair nosing.

10. Stair nosing of claim 1, wherein the shoulder of the nose portion that will abut laminate flooring on the tread of a stair step is a planar surface extending from the front surface of the nose portion and the flange.

11. Stair nosing of claim 1, wherein the shoulder of the nose portion that will abut laminate flooring on the tread of a stair step is a planar surface extending at right angles from the front surface of the nose portion and the flange.

12. Stair nosing of claim 11, wherein a groove extends along the shoulder for interlocking with a tongue on laminate flooring.

13. Stair nosing of claim 1, wherein the shoulder of the nose portion that will abut laminate flooring on the riser of a stair step is a planar surface extending from the front surface of the nose portion and the flange.

14. Stair nosing of claim 1, wherein the shoulder of the nose portion that will abut laminate flooring on the riser of a stair step is a planar surface extending at an obtuse angle from the front surface of the nose portion and the flange.

15. Stair nosing of claim 1, wherein the widths of the groove on the front surface of the nose portion and rib are the same.

16. Stair nosing of claim 1, wherein serrations extend along the groove on the front surface of the nose portion for interlocking with serrations extending along the rib for securely interconnecting the flexible tread and rigid base member.

17. Stair nosing of claim 16, wherein the rib and serrations extending along the rib are sized and the serrations are spaced for interlocking with serrations extending along the side walls of the groove.

18. Stair nosing of claim 16, wherein serrations along the rib extend beyond the rib.

19. Stair nosing of claim 16, wherein a serration along the rib is spaced for engaging the side wall of the groove below the lowest serration extending along the groove.

20. Stair nosing of claim 1, wherein flexible flaps extend from the end of the rib for resisting the removal of the rib from the groove.

21. Stair nosing of claim 16, wherein flexible flaps extending from the end of the rib engage the walls of the groove below the lowest serration.

22. Stair nosing of claim 1, wherein the base member is made by extrusion molding a material selected from the group consisting of metals and rigid synthetic resins.

23. Stair nosing of claim 1, wherein the tread member is made by extrusion molding flexible synthetic resin.

24. Stair nosing of claim 1, wherein the tread member is made by extrusion molding flexible vinyl resin.

25. A stair nosing for the installation of laminate flooring on stair steps, comprising;

an elongated, rigid base member for installation of the stair nosing on the leading edge of a stair step and an elongated, flexible tread member covering and interlocked with the rigid base member, the base member having a nose portion with a rounded front surface for defining a leading edge on a stair step and planar back surfaces that intersect at right angles and flanges extending laterally from and on the same plane as the back surfaces of the nose portion for positioning the base portion on the tread of a stair step, the nose portion having shoulders with planar surfaces extending between the front surface of the nose portion and the front surfaces of the flanges for abutment with laminate flooring installed on a tread, a groove extends along the shoulder that is to abut with laminate flooring on a tread of a stair step for interlocking with a tongue on laminate flooring, the nose portion having a groove extending along its front surface, the flexible tread member having a rib extending from its back surface for engaging the side walls of the groove and interconnecting the base and tread members, the widths of the groove extending along the front surface of the nose portion and rib are the same and serrations extend along the groove on the front surface of the nose portion for interlocking with serrations extending along the rib for securely interconnecting the flexible tread and rigid base member, and the flexible tread member having flaps covering the nose portion and extending beyond the shoulders.

26. Stair nosing of claim 25, wherein the flaps of tread member have pads for holding laminate flooring below the front surface of nose portion.

27. Stair nosing of claim 25, wherein the flaps terminate with sloping shoulders for providing a smooth transition between laminate flooring and the front surface of the stair nosing.

28. Stair nosing of claim 25, wherein the rib and serrations extending along the rib are sized and the serrations are spaced for interlocking with serrations extending along the side walls of the groove.

29. Stair nosing of claim 25, wherein serrations along the rib extend beyond the rib.

30. Stair nosing of claim 25, wherein a serration along the rib is spaced for engaging the side wall of the groove below the lowest serration extending along the groove.

31. A stair nosing for the installation of laminate flooring on stair steps, comprising;

an elongated, rigid base member for installation of the stair nosing on the leading edge of a stair step and an elongated, flexible tread member covering and interlocked with the rigid base member, the base member having a nose portion with a rounded front surface for defining a leading edge on a stair step and planar back surfaces that intersect at right angles and flanges extending laterally from and on the same plane as the back surfaces of the nose portion for positioning the base portion on the tread of a stair step, the nose portion having shoulders with planar surfaces extending between the front surface of the nose portion and the front surfaces of the flanges for abutment with laminate flooring installed on a tread and riser, a groove extends along the shoulder that is to abut with laminate flooring on a tread of a stair step for interlocking with a tongue on laminate flooring, the nose portion having a groove extending along its front surface, the flexible tread member having a rib extending from its back surface for engaging the side walls of the groove and interconnecting the base and tread members, the width of the groove extending along the front surface of the nose portion and rib are the same and serrations extend along the groove on the front surface of the nose portion for interlocking with serrations extending along the rib for securely interconnecting the flexible tread and rigid base member, the rib and serrations extending along the rib are sized and the serrations are spaced for interlocking with serrations extending along the side walls of the groove, a serration along the rib is spaced for engaging the side wall of the groove below the lowest serration extending along the groove and the flexible tread member having flaps covering the nose portion and extending beyond the shoulders.

32. Stair nosing of claim 31, wherein the flaps of tread member have pads for holding laminate flooring below the front surface of nose portion.

33. Stair nosing of claim 31, wherein the flaps terminate with sloping shoulders for providing a smooth transition between laminate flooring and the front surface of the stair nosing.

34. Stair nosing of claim 31, wherein serrations along the rib extend beyond the rib.

* * * * *